US008350653B2

(12) United States Patent
Rhodes et al.

(10) Patent No.: US 8,350,653 B2
(45) Date of Patent: Jan. 8, 2013

(54) ELECTRICAL CONNECTOR SYSTEM

(75) Inventors: Mark Rhodes, West Lothian (GB); Brendan Hyland, Edinburgh (GB); Alexander Ballantyne, Edinburgh (GB)

(73) Assignee: WFS Technologies Ltd., Edinburgh (GB)

( * ) Notice: Subject to any disclaimer, the term of this patent is extended or adjusted under 35 U.S.C. 154(b) by 323 days.

(21) Appl. No.: 12/366,856

(22) Filed: Feb. 6, 2009

(65) Prior Publication Data

US 2010/0102915 A1 Apr. 29, 2010

(30) Foreign Application Priority Data

Oct. 29, 2008 (GB) ..... 0819862.4

(51) Int. Cl.

| | |
|---|---|
| ***H01F 27/02*** | (2006.01) |
| ***H01F 21/04*** | (2006.01) |
| ***H01F 21/06*** | (2006.01) |
| ***H01F 17/06*** | (2006.01) |
| ***H01F 27/30*** | (2006.01) |
| ***H01F 27/28*** | (2006.01) |

(52) U.S. Cl. ..... 336/83; 336/82; 336/90; 336/115; 336/120; 336/121; 336/178; 336/198; 336/220; 336/229

(58) Field of Classification Search ..... 336/5, 82, 336/83, 90, 115, 120, 121, 178, 198, 220, 336/229

See application file for complete search history.

(56) References Cited

U.S. PATENT DOCUMENTS

| | | | | |
|---|---|---|---|---|
| 4,223,313 | A | 9/1980 | Chabrol | 340/870.07 |
| 4,675,638 | A * | 6/1987 | Szabo | 336/83 |
| 5,229,652 | A * | 7/1993 | Hough | 307/104 |
| 5,272,350 | A | 12/1993 | Solari | 250/551 |
| 5,572,178 | A * | 11/1996 | Becker et al. | 336/120 |
| 5,747,894 | A | 5/1998 | Hirai | 307/104 |
| 6,188,327 | B1 | 2/2001 | Cousins | 340/853.9 |
| 6,268,785 | B1 * | 7/2001 | Kollman et al. | 336/83 |
| 6,512,437 | B2 * | 1/2003 | Jin et al. | 336/178 |
| 6,793,634 | B2 * | 9/2004 | White et al. | 600/585 |
| 7,197,113 | B1 * | 3/2007 | Katcha et al. | 378/101 |
| 2004/0119576 | A1 * | 6/2004 | Nakao et al. | 336/225 |
| 2007/0035883 | A1 * | 2/2007 | Katcha et al. | 360/281.8 |
| 2007/0254726 | A1 | 11/2007 | Iida | 455/572 |
| 2010/0200295 | A1 | 8/2010 | Schimanski | 175/45 |

FOREIGN PATENT DOCUMENTS

| | | | |
|---|---|---|---|
| FR | 2654204 | A * | 5/1991 |
| GB | 2464945 | | 5/2010 |
| JP | 61280607 | | 12/1986 |
| JP | 02031405 | | 2/1990 |
| JP | 02031405 | A * | 2/1990 |
| JP | 09330836 | A * | 12/1997 |
| JP | 2000252145 | | 9/2000 |
| JP | 2000252145 | A * | 9/2000 |
| JP | 2004119748 | | 6/2004 |
| WO | 01/95529 | | 12/2001 |
| WO | 2006/134331 | | 12/2006 |
| WO | 2007/099300 | | 9/2007 |

* cited by examiner

*Primary Examiner* — Mohamad Musleh
*Assistant Examiner* — Tsz Chan
(74) *Attorney, Agent, or Firm* — Paul Davis; Goodwin Procter LLP

(57) ABSTRACT

The present invention relates to a connector system that provides the transfer of electrical power and/or data communications signals between two systems. The connector has no conductive electrical connection and can operate independently of angular orientation.

33 Claims, 12 Drawing Sheets

ELECTRICAL CONNECTOR SYSTEM

CROSS-REFERENCE TO RELATED APPLICATIONS

This application claims the benefit of commonly owned GB 0819862.4 filed Oct. 29, 2008, which application is fully incorporated herein by reference.

INTRODUCTION

The present invention relates to a connector system providing transfer of electrical power and or data communications signals between two systems. The connector has no conductive electrical connection and can operate independently of angular orientation.

BACKGROUND

Electrical connections are a challenging aspect of underwater electrical system design, electrical conductive contact being the most common method of implementing an electrical mateable connector. Electrically conductive contact connectors are commonly subject to corrosion and contamination, which can result in a resistive contact point and failure of the connector function. In under water applications water must be excluded from the conductive contacts to prevent short circuits due to the partially conductive nature of water. Wet mating connections are even more challenging since water must be expelled from the conductive contacts during mating and care must be taken to ensure the signal is not applied to the connector while the contacts are exposed to the water before the connection is made to avoid rapid electrolytic corrosion. Connectors that do not rely upon direct conductive contact avoid these issues.

Additionally, any multi-pin connector must be rotationally aligned to ensure registration of the intended cross connections. This requirement can be problematic, particularly in applications where the connection point is not readily accessible by an operator such as connection by an autonomous system deep in the ocean. Slip ring connectors have been designed to avoid this issue but typically employ conductive brush contacts which are subject to corrosion and contamination issues, suffer continuous mechanical wear in rotating applications and present the challenging requirement of an underwater sealed rotating mechanical joint to exclude water from the brush contacts. An electrically insulated data and power connection which mates independent of angular alignment would be beneficial in many underwater applications.

Slip rings may be located at the axis of rotation or with an open bore positioning the ring coupling mechanism set out a radial distance from the axis of rotation. This second class of slip ring is defined as "off axis".

SUMMARY OF INVENTION

The present invention relates to an off axis connector system for the transfer of electronic signals and/or electrical power between two units without the need for direct electrically conductive contact and independent of connector rotation about the mating axis. Signals are communicated by employing magnetic coupling to remove the need for direct electrical conductive contact.

Preferably, the connector employs a circular coil structure surrounded by a flux guiding enclosure that inductively couples energy from a primary winding to a secondary coil arranged at an equal radial distance displaced along the axis of symmetry. The flux guiding enclosure is elongated in the radial plane to reduce the magnetic reluctance of the gap, which is present at the mating surface.

Multiple independent channels may be implemented by arranging multiple coupling coils at different radial distances in a common plane centered round a common axis. The design can support multiple independent power or data channels independent of connector rotation about the axis of symmetry.

The electrically insulated nature of the connector assembly lends itself to underwater applications or situations where there is a high probability of liquid contaminants. The connector provides a highly reliable underwater connector function without the limitations imposed by the need to keep a conductive contact dry. The connector can also be "wet mated" entirely submerged under water without the need to devise a complex mechanical assembly to expel water from the contact area.

Coupling efficiency is improved by minimising the gap between flux guiding enclosures at the mating surface. This connector design has two distinct classes of application. Firstly as a static connection that can be mated independent of angular orientation so simplifying automated connector mating. Here the mating faces are not required to rotate significantly once the connection has been made so the gap between faces can be minimised by using metal to metal contact or physical contact of protective painted surfaces. A second class of application is as a rotating connector and in this case, mechanical measures must be taken to reduce friction between rotor and stator at the mating surface. In this case a plastic sheet will be attached to the mating surface of each connector half preferably constructed from an oil impregnated nylon material or alternative material exhibiting low sliding kinetic friction.

According to one aspect of the present invention there is provided an electrical connector comprising a circular primary coil winding magnetically coupled to a secondary circular coil in a connected mating half through a magnetic flux guiding structure that is elongated either side of the coil in the plane of the coil to form flux coupling wings. The connector structure is rotationally symmetric with an unoccupied area about the centre of symmetry. Connector mating is independent of angular orientation about the connector's axis of symmetry The primary and secondary coils are substantially aligned about a common axis of rotational symmetry and the cross sectional width of the rotationally symmetric connector structure is less than the inner radius dimension.

The flux guiding structure is constructed from a material having a relative permeability greater than 10 and comprises flux coupling wings either side of a central coil enclosure. It is composed of at least two sections divided by a linking electrically insulated material. Wing length is greater than 2 times the flux guide material thickness and less than 50 times the gap dimension separating the primary flux guide from the secondary flux guide at the mating surface. A material with low coefficient of sliding kinetic friction is located between the mating surfaces to facilitate relative rotation of the connector halves.

Multiple independent connection channels are implemented by separate concentric primary coils coupled to corresponding secondary coils The connector components allow mating to any other connector component.

The volume enclosed by the flux guiding structure is filled with electrically insulating material in at least one position along its circumference or continuously filled with insulating material to prevent a shorted loop resulting from the enclosed partially conductive water.

An optical communications connector or conductive slip ring connector may be positioned at the centre of rotational symmetry to provide additional independent functionality.

BRIEF DESCRIPTION OF DRAWINGS

Various aspects of the invention will now be described by way of example only and with reference to the accompanying drawings, of which.

DETAILED DESCRIPTION OF THE DRAWINGS

Figure 1:
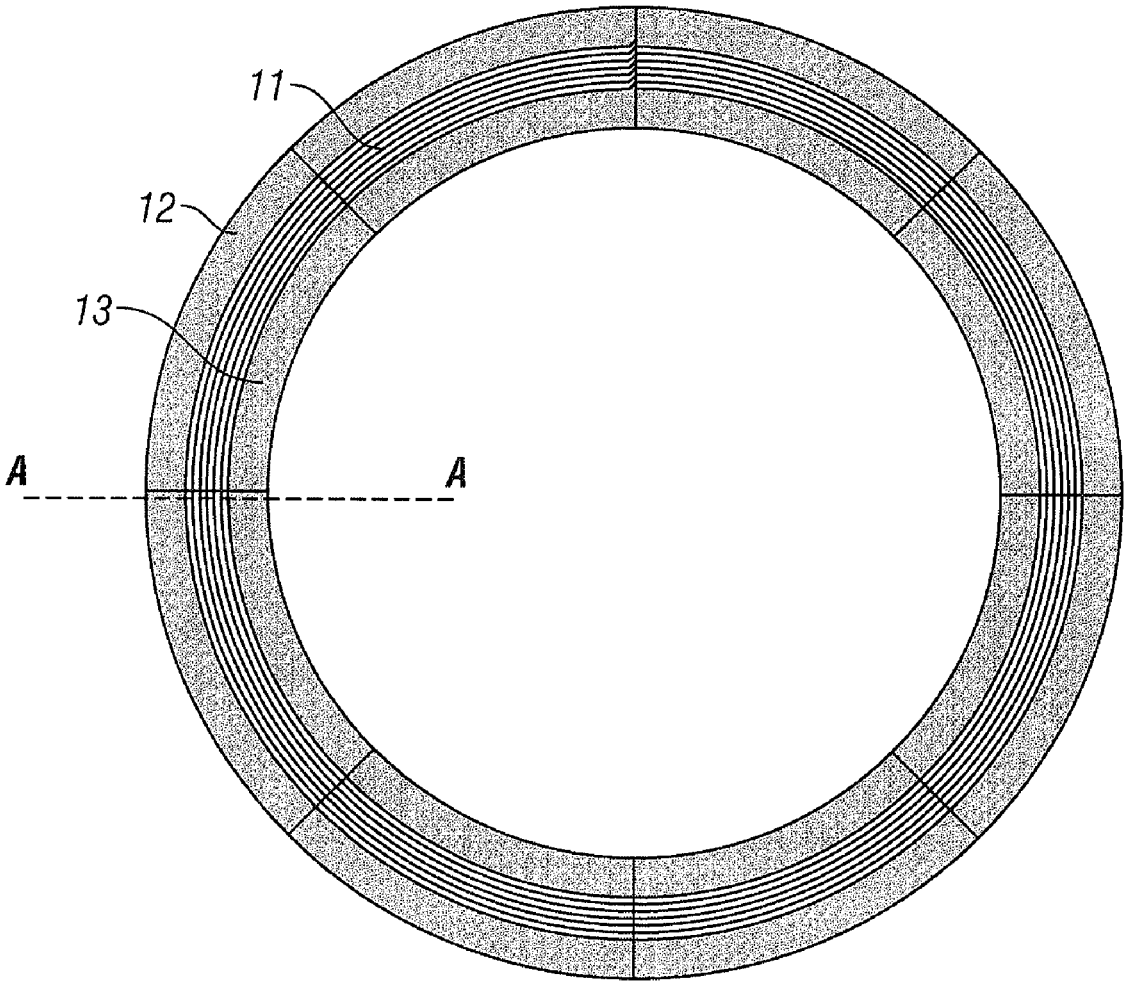
FIG. 1 shows the mating face of a single channel connector.

FIG. 1 shows the mating face of a single channel connector. Multiple circular turns 11 form the primary coil of a transformer system. A ferrous metal flux guiding structure encloses the coil and is extended to form coupling "wings" 12 and 13. The central region of the structure is open and is available to enclose other structures, for example local mechanical structures, without significantly affecting connector performance. This class of slip ring connector is often termed "off-axis". Section A-A is represented in detail in FIG. 2. Typically, the cross sectional width of the rotationally symmetric connector structure through section A-A, is less than the inner radius dimension.

Figure 2:
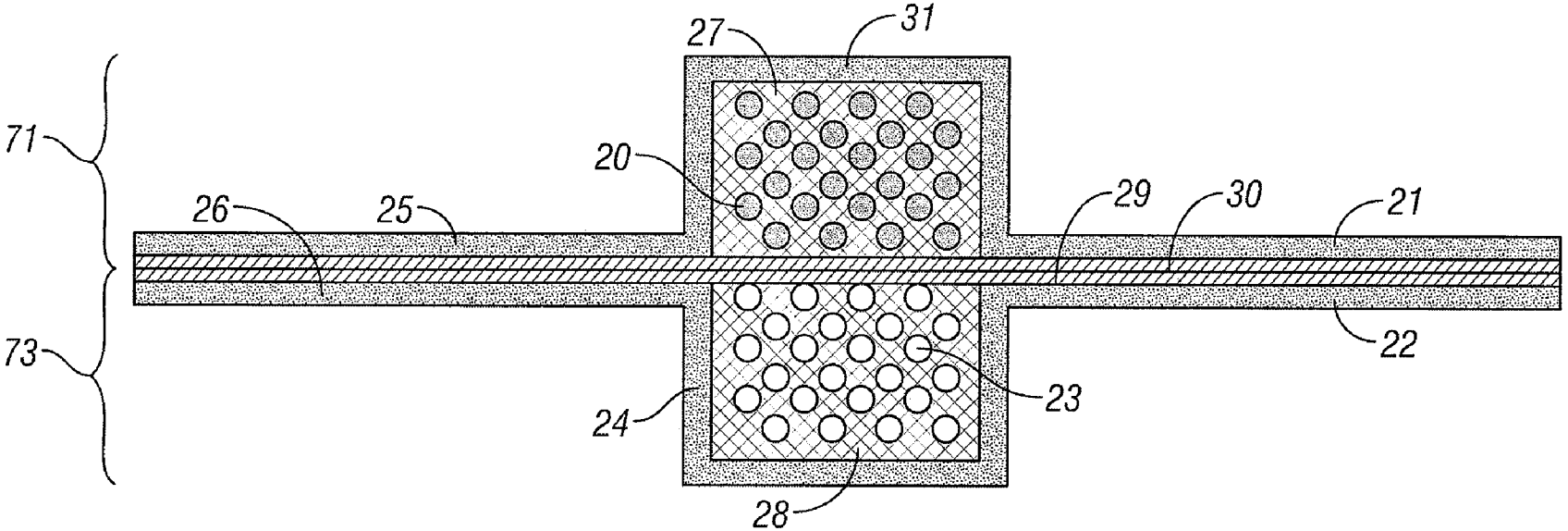
FIG. 2 shows a cross sectional view through part of the rotationally symmetrical mated connector.

FIG. 2 shows a cross sectional view through part of a rotationally symmetrical mated connector that has a first half 71, of the form shown in FIG. 1, that has a multiple turn primary coil 20 and a second half 73 of similar shape and construction in which is located a multiple turn secondary coil 23. The cross section is symmetrical about a horizontal plane and this plane of symmetry represents the mating surface between the two-connector halves. Both halves are mechanically similar, which allows the possibility of mating any connector to any other without the limitations imposed by a more typical keyed conductive connector. This degree of connection flexibility is commonly referred to as a "hermaphrodite" connector.

Enclosing the primary coil is a first flux guiding structure 31 and enclosing the secondary coil is a similarly shaped second flux guiding structure 24. Each guiding structure 24, 31 is elongated parallel to the mating surface to form wings 21, 22, 25 and 26. Wing structures 21, 22, 25 and 26 increase the surface area of the coupling region so reducing the magnetic reluctance of the gap at the interface between the first and second connector halves. The effective relative permeability of the whole magnetic circuit is determined almost entirely by the gap distance and relatively little by the relative permeability of the core material.

For applications that experience regular rotational movement between the connector halves, bearing surfaces 29 and 30 are formed from a material with a low coefficient of sliding kinetic friction. Layer 30 is bonded to the top connector half while layer 29 is bonded to the lower half. Nylon impregnated with lubricating oil will be a suitable material for some applications. Layers 29 and 30 ensure a controlled separating distance between the two flux guiding enclosures and low mechanical resistance to rotational movement. This reduces the torque necessary to maintain rotational movement where desired and improves the deployed operational life of the connector due to reduced mechanical abrasion.

Flux guides, 24 and 31, of the two, mated connectors form a magnetic circuit which couples magnetic flux generated in the primary 20 to the secondary coil 23. The selected magnetic material may have a comparatively low value of relative permeability (for example 10) allowing the freedom to select a material with suitable mechanical and chemical properties for this challenging underwater application. Flux guides may be manufactured from a ferrous metal, for example 316 or 904L marine grade stainless steel.

Regions 27 and 28 represent the area within the flux guiding enclosure not fully occupied by the transformer coil materials. If water were allowed to occupy these regions it would form a shorted turn due to the partially conductive nature of impure water. A current would be induced in opposition to the transformer coils and this would impact connector efficiency. To avoid this effect areas 27 and 28 are filled with an insulating material either continually around the connector circumference or at intervals to break the parasitic conductive circuit. For ease of manufacturing these areas can preferably be filled with an insulating epoxy resin material.

Figure 3:
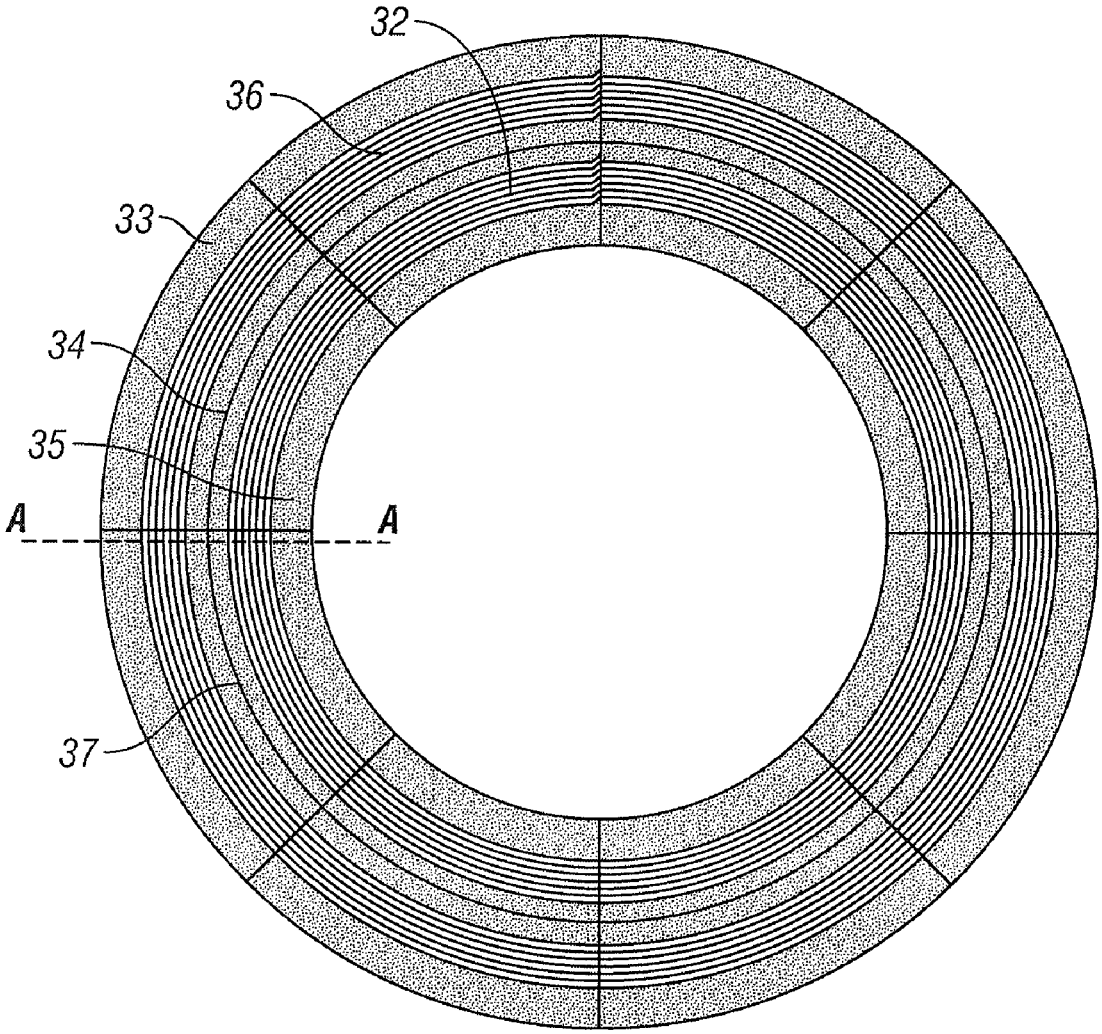
FIG. 3 shows the mating face of a two channel connector.

FIG. 3 shows the mating face of a two-channel connector. In this case, two separately wound primary coils 32 and 36 are provided within flux guiding enclosures 33, 34 and 35. This principle can be extended to implement any number of independent channels by adding additional independent coils at separate radial distances. Separate channels may be used to carry independent communications channels or a mixture of power and data channels. Multiple power channels may be added to increase the power capacity of the connector system. In some implementations a gap 37 is introduced between two adjacent wings to reduce cross coupling between adjacent channels.

Figure 4:
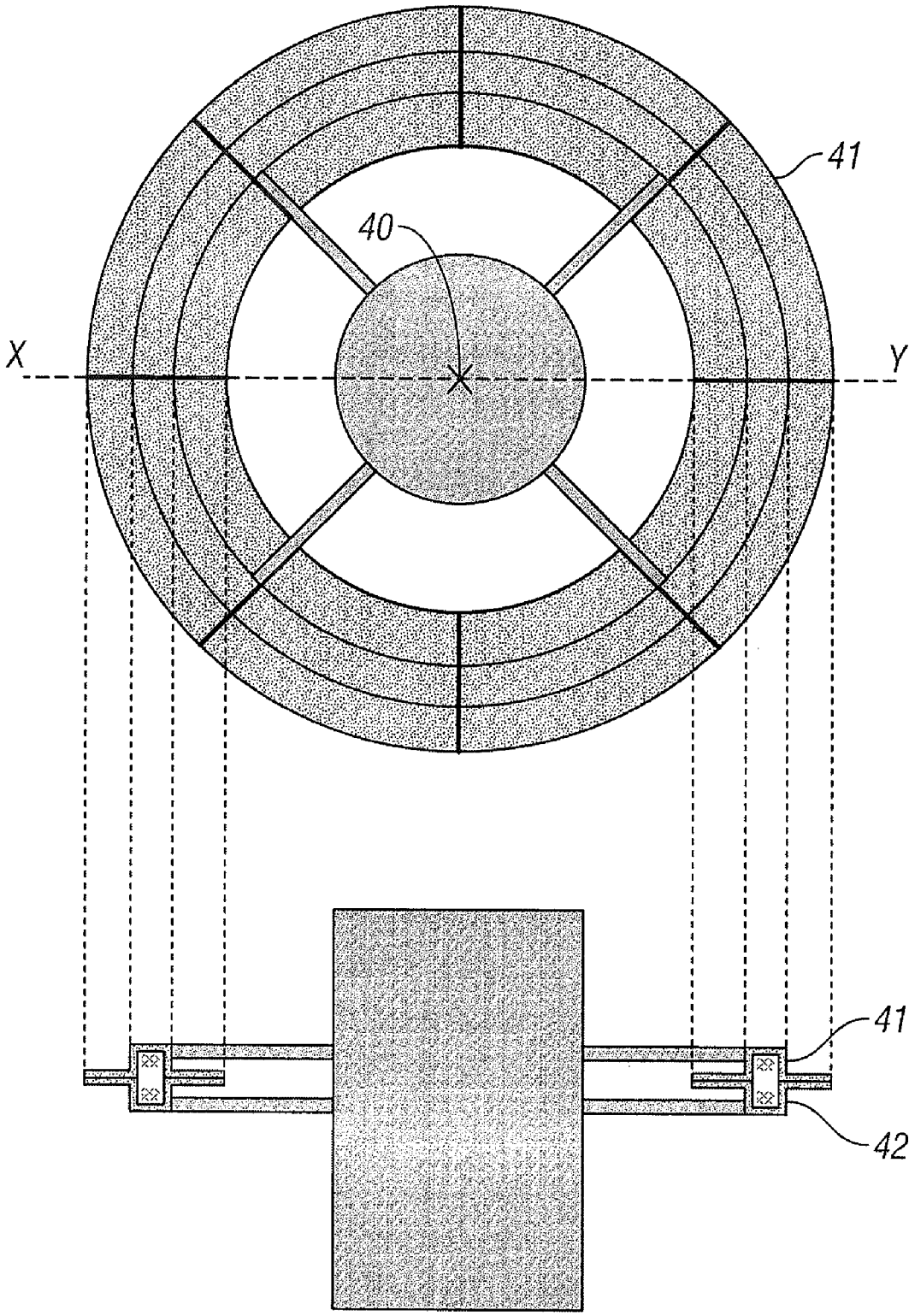
FIG. 4 shows a plan and cross sectional view of the connector installed around a pipe section.

FIG. 4 shows a plan of the connector installed around a pipe section 40 and a cross sectional view taken through the plane marked X-Y on the plan view. The plan view shows a static component 41 for mating with the underside of a rotatable component 42. Advantageously, the connector of FIG. 4 can be deployed around an existing structure, as illustrated by the pipe 40. The pipe will have minimal impact on the connector efficiency since the flux guiding enclosure effectively contains the coupling region within the connector structure.

Figure 5:
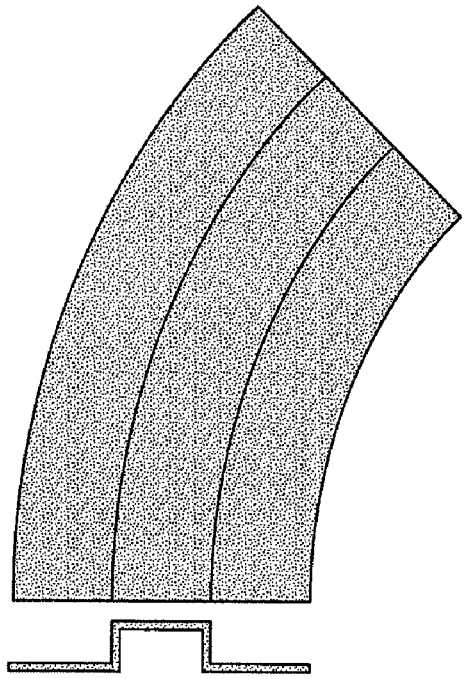
FIG. 5 shows plan and cross section for a single section of the flux guiding enclosure.

FIG. 5 shows plan and cross section for a single section of the flux guiding enclosure of FIGS. 1 and 2. The material chosen for the flux guiding structure may have significant bulk electrical conductivity so the circular structure must be insulated at some point along its radius to prevent a shorted conductive turn, which would reduce connector efficiency. Flux guide sections are connected using an electrically insulating material to avoid a shorted turn. FIG. 5 illustrates a 45 degree section but the number of sections selected for a particular installation is a design freedom governed by ease and cost of manufacture.

Figure 6:
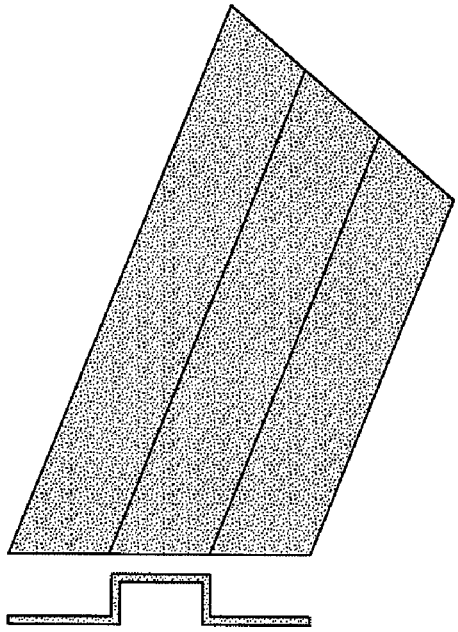
FIG. 6 shows plan and cross section for a single section of the flux guiding enclosure manufactured using linear materials.

FIG. 6 shows plan and cross section for a single section of the flux guiding enclosure manufactured from straight section materials. The width of the flux guiding wings introduces a degree of tolerance to radial miss-alignment of the primary to secondary coils. This feature allows the possibility of constructing the circular structure from a number of linear sections with attendant simplification, and hence cost reduction, of the manufacturing process.

Figure 7:
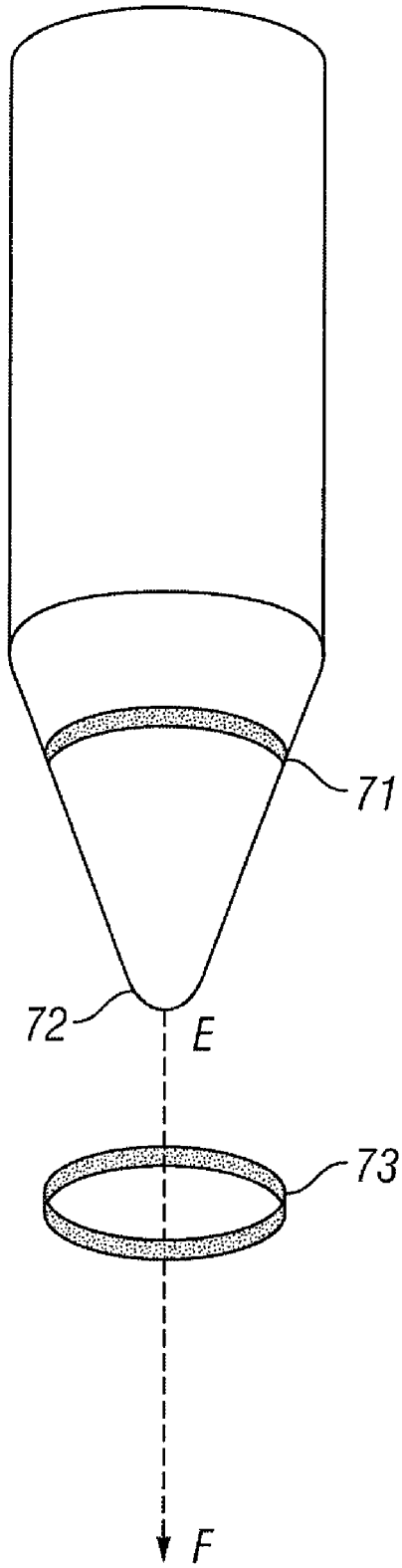
FIG. 7 shows a connector element mounted on a conical guiding pin to reduce the alignment accuracy required for mating.

FIG. 7 shows one half of a connector 71 mounted on a conical guiding pin 72 for mating with a coupling ring 73 Using a conical guide 72 reduces the alignment accuracy required for mating. Connector mating can tolerate an initial centre miss-alignment by a distance equal to ± the coupling ring 73 inner radius since the conical pin section will act to guide the connector if given freedom of movement perpendicular to the mating travel direction E-F.

Figure 8:
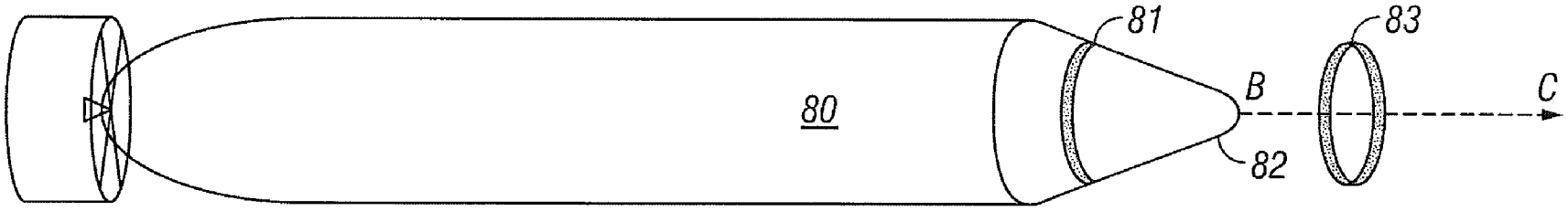
FIG. 8 shows a connector element mounted on a submersible vehicle where a guiding pin forms part of the vehicle's nose section.

FIG. 8 shows a connector for a submersible vehicle 80. In this case, the first component 71 is mounted on the vehicle's nose section 82, which is shaped to form a connector guiding structure. The submersible vehicle 80 moves along axis B to C, as indicated in the diagram, to make contact with the second connector 73. Connector mating can tolerate miss-alignment of the vehicle heading by a distance equal to ± the coupling ring inner radius since the conical nose section will act to guide the vehicle's final approach. This arrangement is particularly beneficial since the mating axis is aligned with the vehicle's primary direction of travel. The nature of submerged vehicle dynamics ensures the necessary freedom of guided movement in the plane perpendicular to the direction of travel.

Connector coupling is essentially due to a transformer action. Primary and secondary windings may be arranged with a turns ratio desired by the individual application with the resultant relationship between primary and secondary voltage following the usual transformer design principles.

Direct contact of the metallic flux guiding enclosures may be acceptable in applications where little relative rotational movement is experienced. In applications with significant angular rotation direct metallic contact is unlikely to be acceptable due to mechanical abrasion and frictional resistance to movement and in these applications a gap must be devised between flux guides. A non-magnetic material such as PTFE (Poly Tetra Fluoro Ethylene) may be used as a spacer, but the effect is similar to the introduction of an air gap into the core of a magnetic induction device. The size of the gap is critical and is related to most of the key performance measures of the device. Coupling efficiency decreases with increasing gap size and in many applications the spacer layer will several millimeters thick.

The flux guide design features extended "wings" to each side of the winding. These are intended to reduce the reluctance of the magnetic circuit that is much higher than normal in a transformer due to the gap at the mating surface. The larger the wings, the lower the reluctance of the magnetic circuit, minimising the impact of the gap on performance. However, because most of the flux is concentrated near the windings, there are diminishing returns as the wings are extended.

Figure 9:
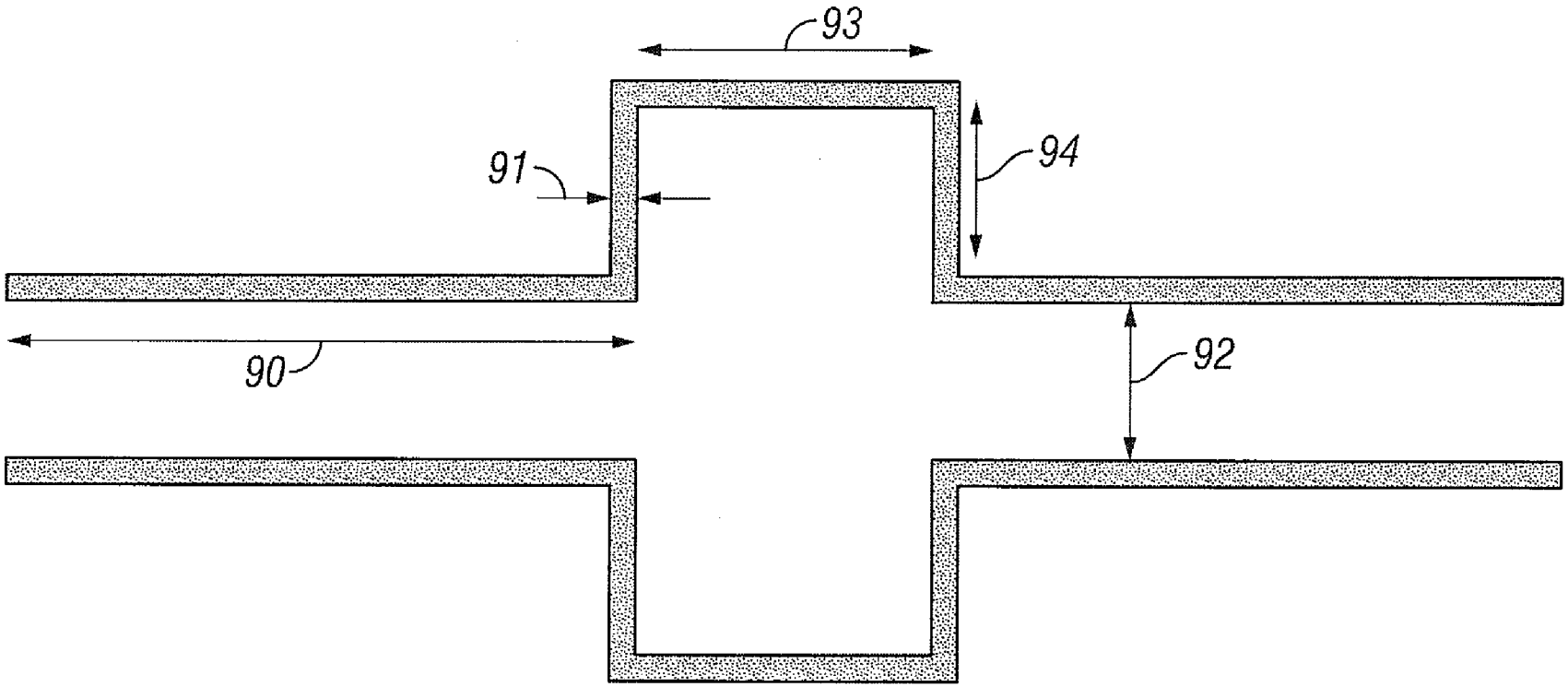
FIG. 9 shows dimensions relevant to flux guide design.

FIG. 9 shows dimensions relevant to flux guide design. The design aim is to reduce the reluctance of the magnetic circuit formed by the primary flux guide, gaps and secondary flux guide. The magnetic reluctance of each of these elements is defined by equation 1. Total reluctance of the magnetic circuit is simply the sum of primary flux guide, inner gap, secondary flux guide and outer gap reluctance.

$$R = \frac{L}{\mu_0 \mu_r A} \qquad \text{Equation 1}$$

where R=Magnetic reluctance 1/H

L=flux path length m

A=flux path cross sectional area $m^2$ $\mu_0$=free space permeability $N/A^2$ $\mu_r$=material relative permeability Without the proposed wing structure, the total magnetic reluctance is dominated by the gap since relative permeability is close to unity while the ferrous core material of the flux guide may have a relative permeability of over 1000. By including the wing structure the cross sectional area of the air gap, or plastic spacer, can be increased by many times hence lowering the reluctance of this circuit element. The gap path length can also be minimised and the small gap length to area ratio can compensate for the low permeability of this section. Wing length 90 will beneficially be greater than twice the guide material thickness 91 and typically sees little benefit from further extension once the gap reluctance is small compared to the flux guide reluctance.

The magnetic circuit formed by the flux guide enclosures must provide enough space to accommodate the primary winding that provides the magneto-motive force in the system. The secondary flux guide must also accommodate a secondary winding of similar or slightly larger size. The winding cavity must also provide space for insulating material and protective encapsulation for safe and reliable operation at the required voltage and temperature in a conductive seawater environment. The flux guide design dimensions are represented by; 93 the horizontal covering section; 94 the side wall height; 91 the flux guide thickness; 90 the wing width.

The number of turns in the windings is partly determined by the need to control the magnetising current and more turns are needed in this case because of the high reluctance in the magnetic circuit due to the gap. The copper loss under no-load conditions will be high as a result and a large winding aperture is required to accommodate large cross section wire to reduce electrical resistance. In FIG. 9, dimensions 93 and 94 should be minimised to fit closely around the required transformer coil volume.

Transformer core losses due to eddy currents are proportional to core volume and in the present design the flux guide enclosure acts as a transformer core. However, the volume of the core must be sufficient to avoid magnetic saturation. For mild steel, the saturation flux density is about 1.5 Tesla.

Figure 10:
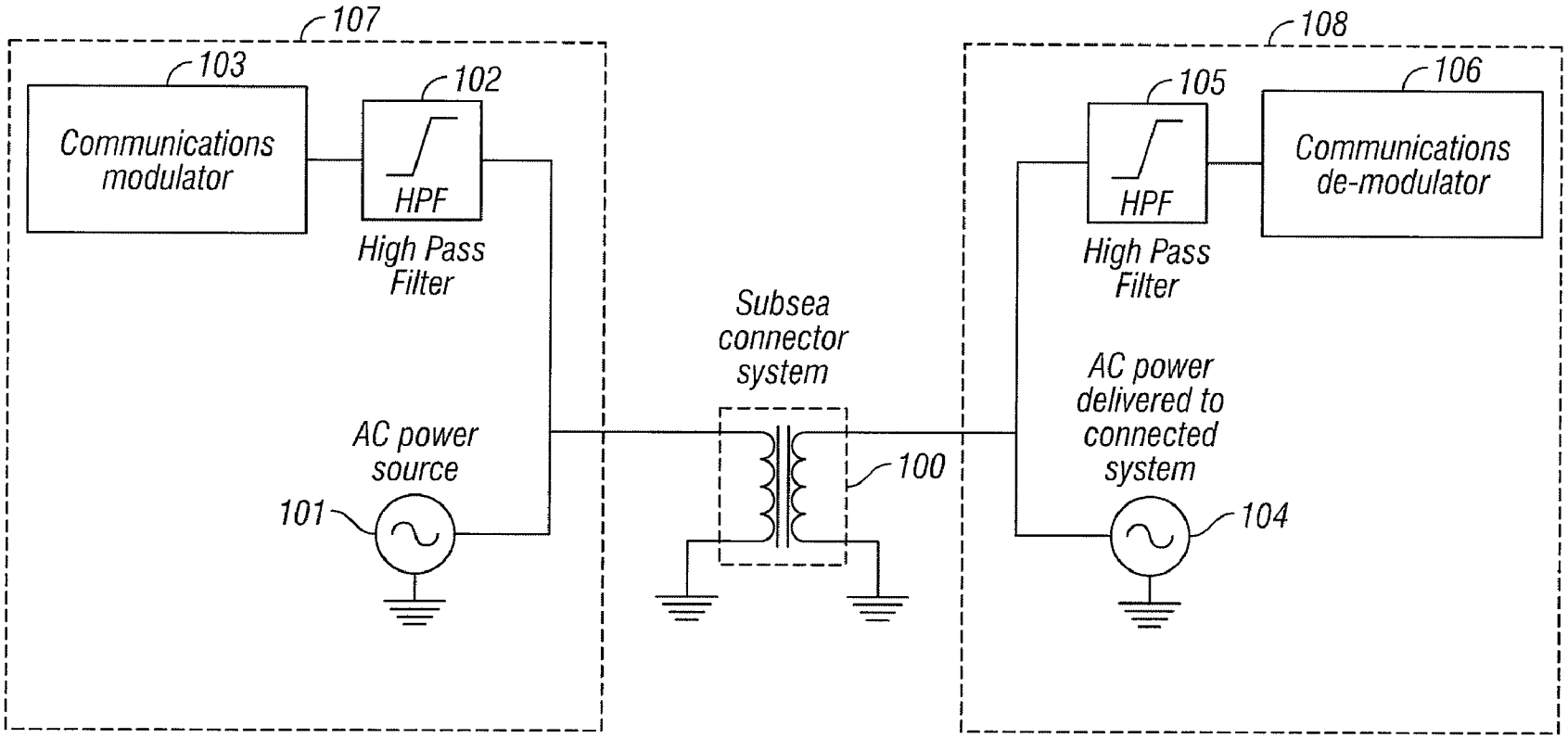
FIG. 10 shows an example application of the connector system that transfers electrical power and data from one system to a connected system.

FIG. 10 shows an example application of the connector system that transfers electrical power and data from a source system 107 to a connected system 108 The source system 107 includes a data source 103 and an AC power source 101 the outputs of which are coupled into the primary coil of the connector. The connected system 108 is coupled to the secondary connector coil, so that data and/or power can be magnetically coupled from the source system 107 to the other system 108 via the primary and secondary coils. Coupling efficiency reduces as frequency increases because of leakage inductance effects. Eddy current losses increase with frequency so also act to reduce the bandwidth available for data transmission. Data and power transmission can be separated in frequency to allow simultaneous operation of the two functions. Transfer efficiency is more critical for power transfer than for communications applications so a higher frequency will usually be assigned to the communications signal.

Communications modulator 103 takes a data input and generates an analogue or digital modulated carrier signal. A high pass filter 102 can be used to isolate the modulator 103 from high power AC (Alternating Current) source 101. Subsea connector system 100 couples the AC power signal and communications signal to the connected system 108. The communications signal can be separated from the AC power in the secondary coil by a high pass filter arrangement 105. Data is extracted from the modulated carrier at the communications de-modulator 106. The larger coupled waveform delivers AC power 104 to the connected system.

By way of example an inductive connector system of the type described here with an internal diameter of 1.8 m and external diameter of 2 m is supplied with a 240 V, 4.2 A r.m.s. alternating current, 1 kW power. Primary to secondary coil turns ratio is 1:1 delivering a 240 V r.m.s. supply to the secondary coupled system. An oil impregnated nylon spacer fills the 2 mm gap between the connector halves to provide low friction rotational movement. The primary and secondary coils are constructed from 100 turns of 12 AWG enamelled copper wire occupying a cross sectional area 30 mm wide by 20 mm deep. The flux guide is manufactured from 5 mm thick 316 grade stainless steel.

Figure 11:
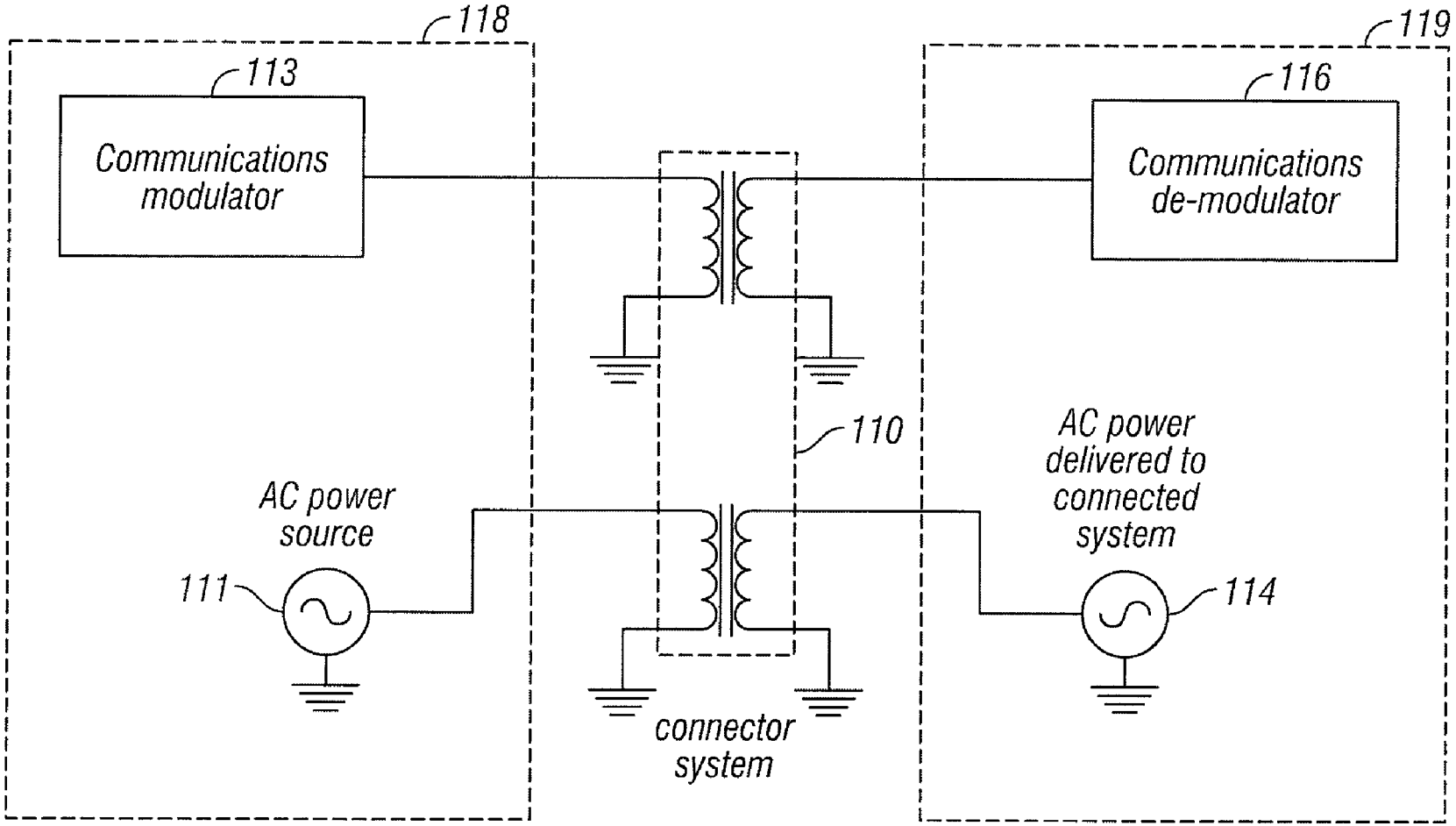
FIG. 11 shows an alternative arrangement that couples power and data through separate channels in a single multichannel connector structure.

FIG. 11 shows an alternative arrangement that couples power and data through separate channels in a single multi-channel connector structure. Communications modulator 113 in system 118 takes a data input and generates an analogue or digital modulated carrier signal which is coupled through connector 110 channel A. AC (Alternating Current) source 111 couples through connector 110 channel B to the connected system 119. Data is extracted from the modulated carrier at the communications de-modulator 116. The larger coupled waveform delivers AC power 114 to the connected system.

Figure 12:
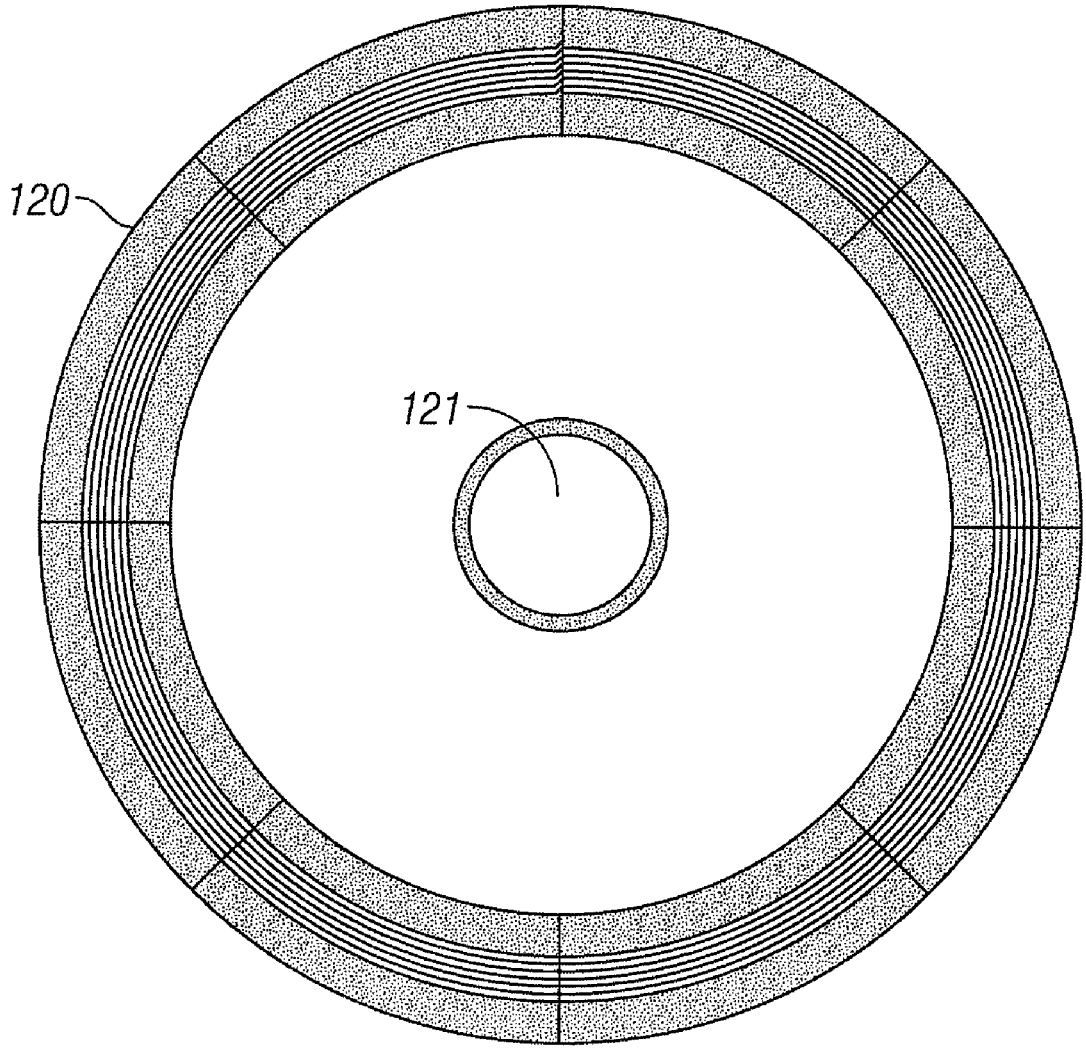
FIG. 12 shows an axial rotary connector positioned at the centre of the connector and, FIG. 13 shows a design for axially registering two mating connectors.

FIG. 12 shows an on-axis rotary connector 121 positioned at the centre of the present connector structure 120. The area around the rotational axis of the present design is not occupied by the present off-axis, open bore connector structure so is available for additional power or data connectors. For example, this connector could be an optical rotary connector as described in CA1166493A1 or a conductive slip ring as described in EP1766761A2 capable of supporting data communications or power transfer.

Figure 13:
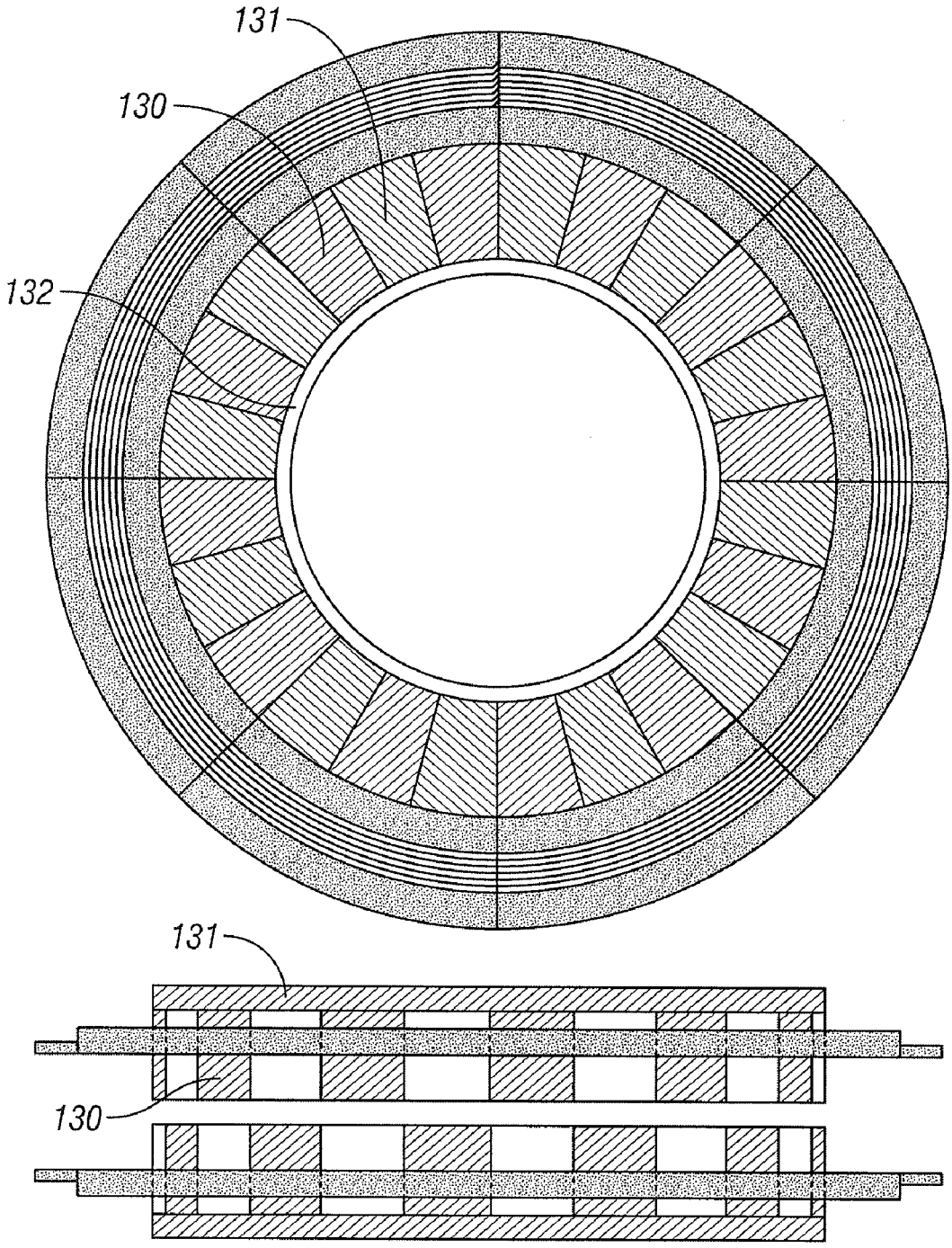

FIG. 13 shows a design for axially registering two mating connectors. The mating parts are annular and mounted in the annulus of the guide structure. Each part has a backing plate 131 that acts as an end stop to movement along the axis of rotation. Mounted on each backing plate 131 are raised crenulations or teeth 130 that interlock one connector component to another so as to prevent rotational movement and axial misalignment. Preferably, the mating parts on each connector part are identical to provide a hermaphrodite connector mating compatibility. To restrict, movement perpendicular to the axis of rotational symmetry, an inner ring structure 132 is provided. This abuts the inner face of the backing plate, without impeding engagement of the crenulations or teeth 130.

No-load losses in this design are large and result from two features; the gap and the solid core. The main contributions to loss are eddy currents in the solid core and primary winding loss due to the magnetising current. Eddy current loss depends on frequency, flux density, core resistance and core shape. To reduce eddy current loss for a given material and magnetic field it is necessary to make the current path long while making the flux path short and in this design the core material must be as thin as possible, while avoiding core saturation. Winding loss depends on the resistance and inductance of the primary winding. Inductance achieved per unit length of winding is low, due to the presence of the gap, therefore a high magnetising current flows and power is dissipated in the resistance of the winding. This leads to a selection of a large cross section wire for the primary winding limited by the practical volume, mass and cost of the assembled coil.

Those familiar with transformer and communications techniques will understand that the foregoing is but one possible example of the principle according to this invention. In particular, to achieve some or most of the advantages of this invention, practical implementations may not necessarily be exactly as exemplified and can include variations within the scope of the invention. For example, a similar system description could apply where a higher permeability ferrite material is selected for the flux guiding enclosure other than that specified in the foregoing examples.

The above description of the specific embodiment is made by way of example only and not for the purposes of limitation. It will be clear to the skilled person that minor modifications may be made without significant changes to the operation described.

The invention claimed is:

1. An electrical connector comprising a primary coil for magnetically coupling to a secondary coil, the primary coil being associated with a magnetic flux guiding structure having a uniform flux guide thickness and being arranged to provide a first horizontal covering section, which is elongated from side walls in the plane of the primary coil to form at least one first flux coupling wing and the secondary coil has a magnetic flux guiding structure having a uniform flux guide thickness and being arranged to provide a second horizontal covering section, which is elongated from side walls in the plane of the secondary coil to form at least one second flux coupling wing, wherein lengths of the first and the second flux coupling wings are greater than the respective lengths of the first and second horizontal covering sections.

2. An electrical connector as claimed in claim 1 wherein, when connected, the primary and secondary coils are aligned about a common axis.

3. An electrical connector as claimed in claim 1 wherein the primary coil is provided in a first connector part and the secondary coil is provided in a second connector part.

4. A connector as claimed in claim 3 wherein one or more of the connector parts are rotatable relative to one another.

5. A connector as claimed in claim 3 wherein the connector parts are rotationally symmetric.

6. An electrical connector as claimed in claim 1 wherein the flux guiding structure is constructed from a material having a relative permeability greater than ten.

7. An electrical connector as claimed in claim 1 wherein the flux coupling wings have a length that is less than fifty times the separation between the primary flux guide and the secondary flux guide at the mating surface, when in a connected position.

8. An electrical connector as claimed in claim 1 wherein the connector is ring-shaped and the cross sectional width of the connector is less than the inner radius dimension.

9. An electrical connector as claimed in claim 1 wherein said flux coupling wings are adapted to be held in direct physical contact in use.

10. An electrical connector as claimed in claim 1 wherein multiple independent connection channels are implemented by separate concentric primary coils and corresponding secondary coils and wherein multiple channels are constructed using separate flux guides spaced by a gap.

11. An electrical connector as claimed in claim 1 comprising a circular flux guide structure composed of at least two sections divided by a linking electrically insulated material.

12. An electrical connector as claimed in claim 1 wherein the flux guide is formed from sections that have a straight section in plan view.

13. An electrical connector as claimed in claim 2 wherein first connector part and second connector part are mechanically designed to allow mating to any other like connector component.

14. An electrical connector as claimed in claim 1 wherein the volume enclosed by the flux guiding structure is filled with electrically insulating material in at least one position along its circumference.

15. An electrical connector as claimed in claim 1 wherein the volume enclosed by the flux guiding structure is filled with electrically insulating material continuously around its entire length.

16. An electrical connector as claimed in claim 1 wherein an optical communications connector or conductive slip ring connector are positioned at the centre of rotational symmetry.

17. An electrical connector as claimed in claim 1 wherein the turns ratio of primary to secondary coils implements a transformer function.

18. An electrical connector system that includes a connector as claimed in claim 1, the system being operable to allow electrical power and data transfer through a common connector channel.

19. An electrical connector system as claimed claim 18 wherein electrical power and data transfer are implemented using separate coupling coils in a multi-channel connector.

20. An electrical connector system as claimed in claim 19 wherein one connector half is disposed around a conical shaped guiding structure.

21. An electrical connector system as claimed in claim 20 wherein one connector half is disposed around a conical section of an underwater vehicle.

22. An electrical connector as claimed in claim 1 adapted to transmit power and communication/data signals in the form of power carrying and communication/data carrying waveforms.

23. An electrical connector as claimed in claim 22 wherein the power carrying and signal carrying waveforms are separated.

24. An electrical connector as claimed in claim 23 wherein the power carrying and signal carrying waveforms are separated in frequency.

25. An electrical connector as claimed in claim 24 wherein one or more frequency dependent filters are provided to prevent the power carrying waveform from impinging on transmit/receiver circuitry for the signal carrying waveform.

26. An electrical connector as claimed in claim 22 or claim 23 wherein the data/communications signal is modulated on the power waveform.

27. An electrical connector as claimed in any of claims 22 to 26 wherein the data/communication signal and power are transmitted in opposite directions.

28. An electrical connector as claimed in claim 1 adapted to transmit data/communication signals in two directions.

29. An electrical connector as claimed in claim 1 including a transmitter that includes a modulator and a receiver that includes a demodulator.

30. An electrical connector as claimed in claim 1 wherein each connector part has a mating structure for mating with the other part for mechanical alignment.

31. An electrical connector as claimed in claim 30 wherein the mating structure on each part is identical.

32. An electrical connector part for use in the connector of claim 1, the connector part comprising a coil and an associated magnetic flux guiding structure that is elongated in the plane of the coil to form at least one flux coupling wing.

33. An electrical connector part as claimed in claim 32 wherein the coil is a primary or secondary coil of a transformer.

* * * * *